US005708454A

United States Patent [19]

Katoh et al.

[11] Patent Number: 5,708,454

[45] Date of Patent: Jan. 13, 1998

[54] MATRIX TYPE DISPLAY APPARATUS AND A METHOD FOR DRIVING THE SAME

[75] Inventors: Kenichi Katoh, Tenri; Hiroshi Yoneda, Ikoma, both of Japan

[73] Assignee: Sharp Kabushiki Kaisha, Osaka, Japan

[21] Appl. No.: 250,493

[22] Filed: May 27, 1994

[30] Foreign Application Priority Data

May 31, 1993 [JP] Japan ..... 5-129774

[51] Int. Cl.[6] ..... G09G 3/36

[52] U.S. Cl. ..... 345/100; 345/87; 345/98

[58] Field of Search ..... 345/98, 96, 99, 345/100, 103, 104; 307/481, 452, 261

[56] References Cited

U.S. PATENT DOCUMENTS

| | | | |
|---|---|---|---|
| 3,999,081 | 12/1976 | Nakajima | 307/481 |
| 4,750,813 | 6/1988 | Ohwada | 345/100 |
| 5,151,690 | 9/1992 | Yamazaki | 345/96 |
| 5,170,158 | 12/1992 | Shinya | 345/98 |
| 5,426,447 | 6/1995 | Lee | 345/103 |

FOREIGN PATENT DOCUMENTS

| | | |
|---|---|---|
| 1-213695 | 8/1989 | Japan . |
| 3-48284 | 3/1991 | Japan . |
| 4-204891 | 7/1992 | Japan . |
| 4208994 | 7/1992 | Japan . |

*Primary Examiner*—Mark R. Powell
*Assistant Examiner*—Matthew Luu

[57] ABSTRACT

A matrix type display apparatus includes pixel electrodes arranged in a matrix, data signal lines and scanning signal lines for driving the pixel electrodes, and a data signal line driving circuit. The data signal line driving circuit includes sampling capacitors for keeping sampled data obtained by sequentially sampling image data over one horizontal scanning period, holding capacitors for holding the sampled data transmitted from the sampling capacitors upon termination of the horizontal scanning period and then outputting the sampled data to data signal lines, and a precharging circuit for precharging the corresponding holding capacitors by applying a predetermined voltage to the holding capacitors before the sampled data is transmitted to the holding capacitors.

24 Claims, 11 Drawing Sheets

MATRIX TYPE DISPLAY APPARATUS AND A METHOD FOR DRIVING THE SAME

BACKGROUND OF THE INVENTION

1. Field of the Invention

The present invention relates to a matrix type display apparatus where a number of pixels are arranged in a matrix for displaying images and the like and a method for driving the same.

2. Description of the Related Art

As shown in FIGS. 14 and 14A, an active matrix type display apparatus includes a display panel 1, a data signal line driving circuit 2, and a scanning signal line driving circuit 3. A number of data signal lines 4 and a number of scanning signal lines 5 are formed on the display panel 1, crossing each other. Pixel electrodes 7 are disposed at the respective crossings of the data signal lines 4 and the scanning signal lines 5 through corresponding pixel switches 6.

Each of the pixel switches 6 is composed of an n-channel TFT, for example: the drain terminal of the TFT is connected to the adjacent data signal line 4, the source terminal thereof to the corresponding pixel electrode 7, and the gate terminal thereof to the adjacent scanning signal line 5. With this configuration, when the scanning signal line 5 is raised to a high voltage level for scanning, the pixel switch 6 connected thereto is turned on. This allows the pixel electrode 7 to be charged to a level corresponding to the voltage at the corresponding data signal line 4. When the scanning signal line 5 is returned to a low voltage level, the pixel switch 6 is turned off. This allows the pixel electrode 7 to keep the charge stored therein. In the case where the display panel 1 is a liquid crystal display panel, a pixel is formed by disposing liquid crystal between the pixel electrode 7 and a counter electrode. An image is thus displayed on the panel corresponding to the charge stored in the pixel electrode 7.

The scanning signal line driving circuit 3 sequentially selects all the scanning signal lines 5 one by one within one vertical scanning period, and outputs a signal of the high voltage level to the selected scanning signal line 5 during the selection period, thereby effecting the scanning. The data signal line driving circuit 2 sequentially samples image data sent thereto in series every horizontal scanning period and distributes the resultant sampled data to the data signal lines 4.

FIG. 15 shows a configuration of the conventional data signal line driving circuit 2, which includes a sampling control circuit 11, and a set of a sampling switch 12, a sampling capacitor 13, a holding switch 14, a holding capacitor 15, and a buffer circuit 16 provided for each data signal line 4. This configuration of the data signal line driving circuit 2 where sampling and holding of data are conducted by the sampling capacitor 13 and the holding capacitor 15 is called a driver-sample-hold type.

The sampling control circuit 11 sequentially outputs sampling signals to all the sampling switches 12 within one horizontal scanning period under the control of a timing control signal sent through a timing control signal line 17. On receipt of the sampling signal, each of the sampling switches 12 is turned on, allowing image data sent through a video signal line 18 at the moment to pass through the sampling switch 12 and to be stored in the sampling capacitor 13 as sampled data. Once all the sampling switches 12 receive the sampling signals and the sampling capacitors 13 are charged with the sampled data, all the holding switches 14 are turned on under the control of a transmission control signal sent through a transmission control signal line 19. The sampled data stored in the sampling capacitors 13 are then transmitted to the respective holding capacitors 15 and are output to the respective data signal lines 4 through the buffer circuits 16.

In the data signal line driving circuit 2 shown in FIG. 15, the image data is sequentially sampled and stored in the sampling capacitors 13 as the sampled data within one horizontal scanning period. Then, the sampled data is transmitted to the holding capacitors 15 during the retrace interval of the horizontal scanning. Accordingly, the sampled data held in the holding capacitors 15 can be output to the respective data signal lines 4 through the buffer circuits 16 with low impedance over the next horizontal scanning period. During this horizontal scanning period, the next image data can be sequentially sampled and held in the sampling capacitors 13.

FIG. 16 shows another configuration of the conventional data signal line driving circuit 2, which includes a sampling control circuit 11, and a set of a sampling switch 12, a sampling capacitor 13, a buffer circuit 16, and an output switch 20 disposed for each data signal line 4. This configuration of the data signal line driving circuit 2 where sampling of data is conducted by the sampling capacitors 13 and holding of data is conducted by distributed capacitances of the data signal lines 4 is called a driver-sample panel-hold type.

The sampling control circuit 11, the sampling switches 12, and the sampling capacitors 13 are the same as those shown in FIG. 15 and operate as described above. Once all the sampling capacitors 13 are charged, all the output switches 20 are turned on under the control of an output control signal sent through an output control signal line 21. The sampled data stored in the sampling capacitors 13 are then output to the respective signal lines 4 through the buffer circuits 16.

In the data signal line driving circuit 2 shown in FIG. 16, the image data is sequentially sampled and stored in the sampling capacitors 13 as the sampled data within one horizontal scanning period. Then, the sampled data is supplied to the respective data signal lines 4 through the buffer circuits 16 with low impedance during the retrace interval of the horizontal scanning. In this case, the output of the sampled data to the data signal lines 4 should be completed within the retrace interval of the horizontal scanning. Because, in the next horizontal scanning period, new image data must be sequentially sampled and output to distributed capacitances of the data signal lines 4 as holding capacitors.

FIG. 17 shows yet another configuration of the conventional data signal line driving circuit 2, which includes a sampling control circuit 11 and a sampling switch 12 provided for each data signal line 4. This configuration of the data signal line driving circuit 2 where sampling and holding of data are conducted by only distributed capacitances of the data signal lines 4 is called a panel-sample type.

The sampling control circuit 11 and the sampling switches 12 are the same as those shown in FIGS. 15 and 16 and operate as described above. When the sampling switches 12 are sequentially turned on by sampling signals sent from the sampling control circuit 11, image data sent through a video signal line 18 at the moment is output to the respective signal lines 4 as the sampled data.

In the data signal line driving circuit 2 shown in FIG. 17, the output of the sampled data to each of the data signal lines 4 should be completed within the period in which the corresponding sampling switch 12 is on.

FIG. 18 shows the transient performance of a switch such as the pixel switch 6 of the display panel 1, and the sampling switch 12, the holding switch 14, and the output switch 20 of the data signal line driving circuit 2 shown in FIGS. 14 to 17 when they are turned on. Assume that the input side of the switch is in a high voltage level and the output side thereof is in a low voltage level at time t21. When the switch is turned on by receiving a control signal such as the sampling signal at time t21, a long charging time $T_{CH}$ is required to sufficiently raise the voltage at the output side of the switch, because the output side of the switch is connected to a capacitance such as the sampling capacitor 13 and the data signal line 4. In the case where an ON time $T_{ON}$ during which the switch is on is short, the voltage at the output side of the switch will not be sufficiently raised due to an insufficient charging time.

FIG. 19 shows the transient performance of the input/output sides of the buffer circuit 16 of the data signal line driving circuit 2 shown in FIGS. 15 and 16. When the input side of the buffer circuit 16 is raised to a high voltage level from a low voltage level at time t22, a long charging time $T_{CH}$ is required to sufficiently raise the voltage at the output side thereof this is because the output side is connected to a capacitance such as the data signal line 4. In the case where the time during which a current for charging flows through the buffer circuit 16 is short, the voltage at the output side will not be sufficiently raised.

In the conventional display apparatuses, the time allocated for charging pixel electrodes, data signal lines, and the like is limited. For example, in the display apparatus shown in FIGS. 14 and 14A, the pixel electrodes 7 should be charged within the horizontal scanning period when the data signal line driving circuit 2 of the driver-sample-hold type or the driver-sample panel-hold type is used, or within the retrace interval of the horizontal scanning when that of the panel-sample type is used. In the data signal line driving circuit 2 of the driver-sample-hold type shown in FIG. 15, the sampling capacitors 13 should be charged within the sampling period, the holding capacitors 15 within the retrace interval of the horizontal scanning, and the data signal lines 4 within the horizontal scanning period. In the data signal line driving circuit 2 of the driver-sample panel-hold type shown in FIG. 16, the sampling capacitors 13 should be charged within the sampling period, and the data signal lines 4 within the retrace interval of the horizontal scanning. In the data signal line driving circuit 2 of the panel-sample type shown in FIG. 17, the data signal lines 4 should be charged within the retrace interval of the horizontal scanning.

In recent years, in order to achieve matrix type display apparatuses with higher resolution and higher definition, the number of pixels becomes greater. With the increase in the number of pixels, the number of horizontal scannings within one vertical scanning period and the number of samplings within one horizontal scanning period increase, resulting in shortening the horizontal scanning period and the sampling period. This indicates that the time available for charging the pixel electrodes 7 and the data signal lines 4 is further shortened. This is especially true for the data signal line driving circuit 2 of a simpler configuration. In the case of the data signal line driving circuit 2 of the driver-sample-hold type and the driver-sample panel-hold type, the time available for charging the sampling capacitor 13 may also be shortened. Further, in the case of the driver-sample-hold type, the time available for charging the holding capacitor 15, in addition to the time available for charging the sampling capacitor 13, may be shortened.

In a matrix type liquid crystal display apparatus, in order to prevent deterioration of the liquid crystal, the polarity of image data is inverted every vertical scanning period (every field or every frame) to effect alternate driving. This causes a greater potential difference at the switching of the polarity. For example, when a capacitor is charged with a maximum positive voltage, it generally requires to be charged with a maximum negative voltage next time. This produces an extremely large potential difference. When the potential difference between the input and the output of the sampling switch 12, the buffer circuit 16, and the like increases, the charging time $T_{CH}$ shown in FIGS. 18 and 19 becomes longer.

For the above reasons, the conventional matrix type display apparatuses are disadvantageous in that the time available for charging the data signal lines 4, the sampling capacitors 13, the holding switches 14, and the like becomes shorter with the increase in the number of pixels, causing the problem of producing defective display.

In order to solve the above problem, a data signal line driving circuit 2 having a configuration as shown in FIG. 20 has been proposed (Japanese Laid-Open Patent Publication No. 4-208994).

In the data signal line driving circuit 2 of FIG. 20, a sampling capacitor precharging line 23 is connected to a sampling capacitor 13 of the data signal line driving circuit 2 of the driver-sample-hold type shown in FIG. 15 through a sampling capacitor precharging switch 22. The sampling capacitor precharging switch 22 is controlled by a sampling capacitor precharging control signal sent through a sampling capacitor precharging control signal line 24 so that it can be turned on after sampled data stored in the sampling capacitor 13 is transmitted to a holding capacitor 15 through a holding switch 14. This makes it possible for the sampling capacitor 13 to be preliminarily charged (precharged) with a voltage at the sampling capacitor precharging line 23 before being charged with the sampled data when the sampling switch 12 is next turned on. A voltage of an intermediate value between the extreme values of the possible voltage of the next sampled data is applied to the sampling capacitor precharging line 23. By precharging the sampling capacitor 13, the potential difference between the input and the output of the sampling switch 12 when the sampling switch 12 is turned on can be reduced even when the polarity is inverted. This results in a reduction of the time required for charging the sampling capacitor 13.

In the above case, however, the time required for charging the pixel electrodes 7, the holding capacitors 15, and the data signal lines 4 is not reduced. Thus the problem of the insufficient charging time is left unsolved. Moreover, in some cases, it is not preferable to further complicate the already-complicated circuit of the driver-sample-hold type by adding the sampling capacitor precharging switches 22, the sampling capacitor precharging lines 23, and the like.

SUMMARY OF THE INVENTION

One object of the present invention is to solve the aforementioned problems. This object is solved by providing a matrix type apparatus as follows.

The matrix type display apparatus of this invention, comprises: pixel electrodes arranged in a matrix; data signal lines and scanning signal lines for driving the pixel electrodes; and a data signal line driving circuit. The data signal line driving circuit includes, sampling capacitors for keeping sampled data obtained by sequentially sampling image data over one horizontal scanning period, holding capacitors for holding the sampled data transmitted from the sampling capacitors upon termination of the horizontal scanning period and then outputting the sampled data to data signal lines as a data signal, and precharging means for precharging the corresponding holding capacitors by applying a predetermined voltage to the holding capacitors before the sampled data is transmitted to the holding capacitors.

In one embodiment, each of the precharging means includes: a precharging switch temporarily turned on by a precharging signal before the sampled data is transmitted to the holding capacitor; and a precharging line connected to the holding capacitor through the precharging switch and loaded with a predetermined voltage.

In another embodiment, the polarity of the potential for the precharging is the same as the polarity of the data signal.

In another embodiment, the potential for the precharging has an intermediate value between the extreme values of the potential of the data signal.

Alternatively, the matrix type display apparatus comprises: pixel electrodes arranged in a matrix; data signal lines and scanning signal lines for driving the pixel electrodes; and a data signal line driving circuit. The data signal line driving circuit further includes, sampling capacitors for keeping sampled data obtained by sequentially sampling image data over one horizontal scanning period, holding capacitors for holding the sampled data transmitted during one horizontal scanning period and then outputting the sampled data to data signal lines as a data signal, and precharging means for precharging the corresponding holding capacitors by applying a predetermined voltage to the holding capacitors and the data signal lines before the sampled data is transmitted to the holding capacitors.

In one embodiment, each of the precharging means includes: a precharging switch temporarily turned on by a precharging signal before the sampled data is transmitted to the holding capacitor; and a precharging line connected to the holding capacitor through the precharging switch and loaded with a predetermined voltage.

In another embodiment, the polarity of the potential for the precharging is the same as the polarity of the data signal.

In another embodiment, the potential for the precharging has an intermediate value between the extreme values of the potential of the data signal.

Alternatively, the matrix type display apparatus of the present invention comprises: pixel electrodes arranged in a matrix; data signal lines and scanning signal lines for driving the pixel electrodes; and a data signal line driving circuit. The data signal line driving circuit further includes, sampling capacitors for keeping sampled data obtained by sequentially sampling image data over one horizontal scanning period and then outputting the sampled data to data signal lines as a data signal, and precharging means for precharging the corresponding data signal lines by applying a predetermined voltage to the data signal lines before the sampled data is output to the data signal lines.

In one embodiment, each of the precharging means includes: a precharging switch temporarily turned on by a precharging signal before the sampled data is output to the data signal line; and a precharging line connected to the data signal line through the precharging switch and loaded with a predetermined voltage.

In another embodiment, the polarity of the potential for the precharging is the same as the polarity of the data signal.

In another embodiment, the potential for the precharging has an intermediate value between the extreme values of the potential of the data signal.

Alternatively, the matrix type display apparatus of the present invention comprises: pixel electrodes arranged in a matrix; data signal lines and scanning signal lines for driving the pixel electrodes; pixel switches each turned on by a signal sent through the corresponding scanning signal line for supplying a current from the corresponding data signal line to the corresponding pixel electrode; and precharging means for precharging the corresponding pixel electrodes by applying a predetermined voltage to the corresponding pixel electrodes before the corresponding pixel switches are turned on by the signal sent through the corresponding scanning signal lines.

In one embodiment, each of the precharging means includes a precharging switch disposed for each pixel electrode and turned on by one of the scanning signal lines selected prior to the corresponding scanning signal line for turning on the pixel switch for the corresponding pixel electrode, and the corresponding pixel electrode is connected to a data signal line adjacent to the corresponding data signal line through the precharging switch.

In another embodiment, each of the precharging means includes: a precharging switch disposed for each pixel electrode and turned on by one of the scanning signal lines selected prior to the corresponding scanning signal line for turning on the pixel switch for the corresponding pixel electrode; and a precharging line connected to the corresponding pixel electrode through the precharging switch and loaded with the predetermined voltage.

In another embodiment, the polarity of the potential for the precharging is the same as the polarity of a data signal.

In another embodiment, the potential for the precharging has an intermediate value between the extreme values of the potential of the data signal.

Alternatively, the matrix type display apparatus of the present invention comprises: pixel electrodes arranged in a matrix; data signal lines and scanning signal lines for driving the pixel electrodes; and a data signal line driving circuit. The data signal line driving circuit further includes, sampling switches for sequentially sampling image data over one horizontal scanning period, each of the sampling switches being connected to the corresponding data signal line for outputting sampled data to the data signal line as a data signal, and precharge sampling means for effecting precharge sampling by turning on the sampling switches for applying a predetermined voltage to the data signal lines after the completion of the last horizontal scanning period and before the start of the proper sampling period for the respective sampling switches.

In one embodiment, the polarity of the potential for the precharging is the same as the polarity of the data signal.

In another embodiment, the potential for the precharging has an intermediate value between the extreme values of the potential of the data signal.

Alternatively, the matrix type display apparatus of the present invention comprises: pixel electrodes arranged in a matrix; data signal lines and scanning signal lines for driving the pixel electrodes; and a data signal line driving circuit. The data signal line driving circuit further includes, sampling switches for sequentially sampling image data over one horizontal scanning period, each of the sampling switches being connected to a sampling capacitor for outputting sampled data obtained by the sampling to the sampling capacitor as a data signal, the sampling capacitor keeping the sampled data, and precharge sampling means for effecting precharge sampling by turning on the sampling switches for applying a predetermined voltage to the sampling capacitors after the completion of the last horizontal scanning period and before the start of the proper sampling period for the respective sampling switches.

In one embodiment, the polarity of the potential for the precharging is the same as the polarity of the data signal.

In another embodiment, the potential for the precharging has an intermediate value between the extreme values of the potential of the data signal.

In another aspect of the present invention, a method for driving a matrix type display apparatus is provided. The method includes scanning each scanning signal line a plurality of times within one vertical period, each scanning of the same data line being conducted when image signals of the same polarity are applied to data signal lines.

Thus, the invention described herein makes possible the advantages of (1) providing a matrix type display apparatus in which the time for charging pixel electrodes and the like is sufficiently secured even when the apparatus is enhanced in resolution and definition, and (2) providing a method for driving such a matrix type display apparatus.

These and other advantages of the present invention will become apparent to those skilled in the art upon reading and understanding the following detailed description with reference to the accompanying figures.

BRIEF DESCRIPTION OF THE DRAWINGS

FIG. 18 is a time chart showing the transient performance of a switch of a conventional data signal line driving circuit when it is turned on.

DESCRIPTION OF THE PREFERRED EMBODIMENTS

Figure 1:
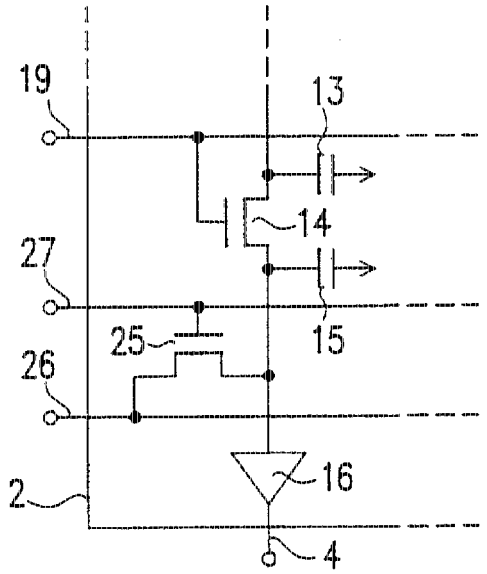
FIG. 1 is a partial circuit diagram of a data signal line driving circuit of the first example according to the present invention.

In one embodiment of the matrix type display apparatus according to the present invention, a holding capacitor is precharged by a precharging circuit before sampled data is transmitted from a sampling capacitor. This reduces the potential difference between the sampling capacitor and the holding capacitor at the transmission of the sampled data, and as a result the time required for charging the holding capacitor is shortened. The precharging is conducted by connecting the holding capacitor to a precharging line through a precharging switch. The voltage at the precharging line is set so that the holding capacitor can be pre-charged with a voltage of the same polarity as that of the sampled data to be transmitted, for example, a voltage of an intermediate value between the extreme values of the possible voltage of the sampled data.

Thus, according to this embodiment, since the time required for charging the holding capacitor is shortened, the holding capacitor can be completely charged. This embodiment is applicable to a data signal line driving circuit of the driver-sample-hold type which includes a holding capacitor in addition to a sampling capacitor.

In another embodiment of the matrix type display apparatus according to the present invention, a data signal line is precharged by a precharging circuit before sampled data is output from a data signal line driving circuit. This reduces the potential difference at the output of the data signal line driving circuit, and as a result the time required for charging the data signal line is shortened. The precharging is conducted by connecting the data signal line to a precharging line through a precharging switch. The voltage of the precharging line is set so that the data signal line can be precharged with a voltage of the same polarity as that of the sampled data to be output, for example a voltage of an intermediate value between the extreme values of the possible voltage of the sampled data.

Thus, according to this embodiment, since the time required for charging the data signal line is shortened, the data signal line can be completely charged.

In yet another embodiment of the matrix type display apparatus according to the present invention, a pixel electrode is precharged by a precharging circuit before being connected to a data signal line through a pixel switch. This reduces the potential difference between the data signal line and the pixel electrode at this connection, and as a result the time required for charging the pixel electrode is shortened. The pre-charging is conducted by connecting the pixel electrode to a precharging line through a precharging switch. The precharging line is set so that the pixel electrode can be precharged with a voltage of the same polarity as that of a voltage at the next data signal line, for example, a voltage of an intermediate value between the extreme values of the possible voltage of the sampled data. Instead of the precharging line, the corresponding data signal line or another data signal line can be used for precharging the pixel electrode. In this case, the polarity of the voltage at the data signal line when the precharging switch is on should be the same as that of the voltage at the corresponding data signal line when the pixel switch is on.

Thus, according to this embodiment, since the time required for charging the pixel electrode is shortened, the pixel electrode can be completely charged.

In yet another embodiment of the matrix type display apparatus according to the present invention, a sampling switch is turned on by a precharging sampling means before the start of the proper sampling period, for sampling image data for the precharging purpose. This reduces the potential difference at the charging and thus shortens the charging time during the proper sampling period. The sampling switch may be turned on for sampling simultaneously with another precedent sampling switch which is turned on for proper sampling, thereby precharging the former sampling switch. Alternatively, all the sampling switches may be simultaneously turned on for precharging, and then individually turned off at different times to effect the proper sampling for charging. Otherwise, all the sampling switches may be simultaneously turned on during the retrace interval of the horizontal scanning to effect precharging. The sampled data preliminarily sampled by the sampling switch is temporarily stored in a sampling capacitor in the case of a data signal line driving circuit of the driver-sample-hold type or the driver-sample panel-hold type, or it is directly output to a data signal line in the case of that of the panel-sample type.

Thus, according to this embodiment, the precharging can be effected only by controlling the timing of the sampling by the sampling switches. This makes it possible to completely charge the sampling capacitor or the data signal line with a simple structure.

In the method for driving the matrix type display apparatus according to the present invention, each scanning signal line is scanned a plurality of times during one vertical period. Such scannings are conducted when image data of the same polarity are sent through data signal lines. Thus, during the earlier scanning or scannings before the final scanning, a row of pixels connected to the scanning signal line are precharged with image data of the same polarity as that of image data to be charged during the final scanning.

Thus, according to this method, each pixel can be completely charged by using the conventional matrix type display apparatuses.

The present invention will now be described by way of example with reference to the accompanying drawings as follows:

(EXAMPLE 1)

Figure 15:
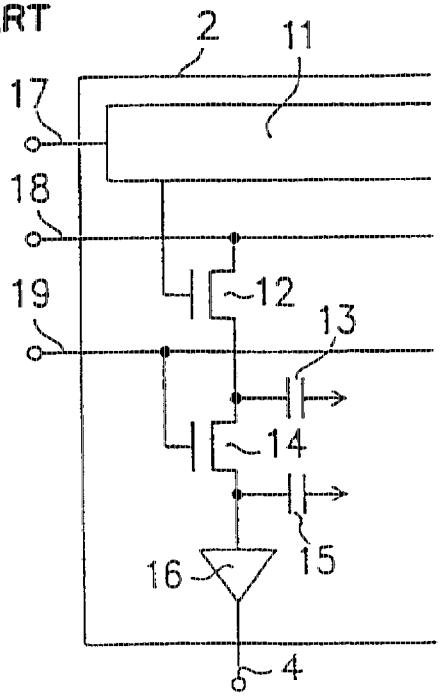
FIG. 15 PRIOR ART
FIG. 15 is a partial circuit diagram of a conventional data signal line driving circuit of a driver-sample-hold type.

This example is based on the data signal line driving circuit of the driver-sample-hold type shown in FIG. 15.

Figure 2:
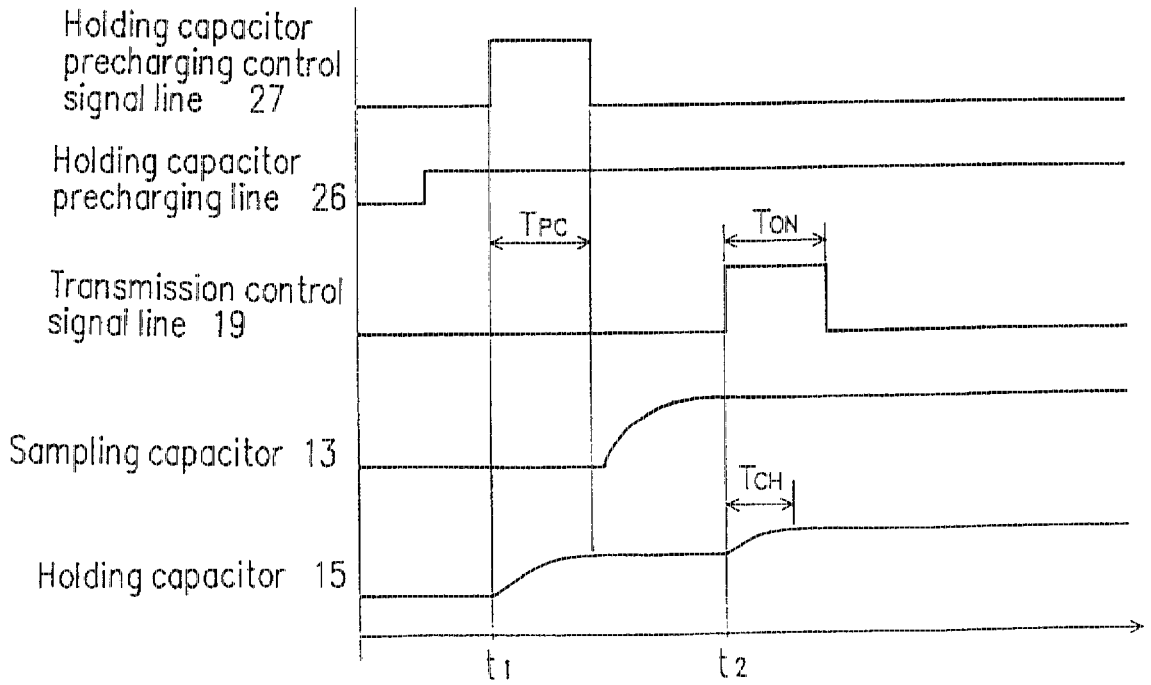
FIG. 2 is a time chart showing the operation of the data signal line driving circuit of FIG. 1.

FIG. 1 is a partial circuit diagram of the data signal line driving circuit of this example, and FIG. 2 is a time chart showing the operation of the data signal line driving circuit of FIG. 1. The components having functions similar to those of the above conventional example are denoted by the same reference numerals.

In the data signal line driving circuit 2 of this example, a terminal of a sampling capacitor 13 is connected to a video signal line 18 through a sampling switch 12 which is controlled by the output signal of a sampling control circuit 11. See FIG. 15 for the components 11, 12, and 18. The same terminal of the sampling capacitor 13 is also connected to a terminal of a holding capacitor 15 through the drain-source terminals of an n-channel MOSFET constituting a holding switch 14. The gate terminal of the n-channel MOSFET of the holding switch 14 is connected to a transmission control signal line 19. Thus, the holding switch 14 is switched on/off by a transmission control signal sent through the transmission control signal line 19. The same terminal of the holding capacitor 15 is also connected to a data signal line 4 through a buffer circuit 16 which is an amplifier with a high input impedance and a low output impedance. The other terminals of the sampling capacitor 13 and the holding capacitor 15 are connected to a power-supply line capable of providing a predetermined voltage, such as the grounding line providing the grounding potential.

The terminal of the holding capacitor 15 connected to the sampling capacitor 13 is also connected to a holding capacitor precharging line 26 through the drain-source terminals of an n-channel MOSFET constituting a holding capacitor precharging switch The gate terminal thereof is connected to a holding capacitor precharging control signal line 27. Thus, the holding capacitor precharging switch 25 is switched on/off by a holding capacitor precharging control signal sent through the holding capacitor precharging control signal line 27.

In the data signal line driving circuit 2 with the above configuration, image data sent through the video signal line 18 is sequentially sampled within one horizontal scanning period, and the resultant sampled data is stored in the sampling capacitors 13. As shown in FIG. 2, at an appropriate time t1 in the horizontal scanning period, the holding capacitor precharging control signal line 27 sends the holding capacitor precharging control signal of a high voltage level. Before time t1, the holding capacitor precharging line 26 has been loaded with a voltage which is of the same polarity as that of the present sampled data and of an intermediate value between the extreme values of the possible voltage of the sampled data. The holding capacitor 15 is then precharged with the voltage at the holding capacitor precharging line 26 during a precharging time $T_{PC}$ in which the holding capacitor precharging control signal line 27 is in the high voltage level.

In the retrace interval after the completion of the horizontal scanning, at time t2, the transmission control signal line 19 sends the transmission control signal of a high voltage level, turning on the holding switch 14 to start the transmission of the sampled data. During an ON period $T_{ON}$ in which the high-voltage level transmission control signal is sent through the transmission control signal line 19, the holding capacitor 15 is charged with the sampled data transmitted from the sampling capacitor 13. According to this example, since the holding capacitor 15 has already been precharged with a voltage of nearly an intermediate value between the extreme values of the possible voltage of the sampled data, it can be charged in a short charging time $T_{CH}$. This ensures that the charging is completed before the termination of the ON period $T_{ON}$. In other words, the potential difference between the sampling capacitor 13 and the holding capacitor 15 of this example is reduced to half at maximum, compared with the case where the holding capacitor 15 has not been charged. It is further reduced as compared with the case where the holding capacitor 15 has been charged with a voltage of the reverse polarity. It is therefore possible to complete the charging of the holding capacitor 15 in a sufficiently short charging time $T_{CH}$.

As a result, according to this example, when the sampled data stored in the sampling capacitor 13 is transmitted to the holding capacitor 15 during the retrace interval of the horizontal scanning, the holding capacitor 15 can be completely charged within a short time period. Therefore, the problem of lost sampled data is prevented.

Figure 20:
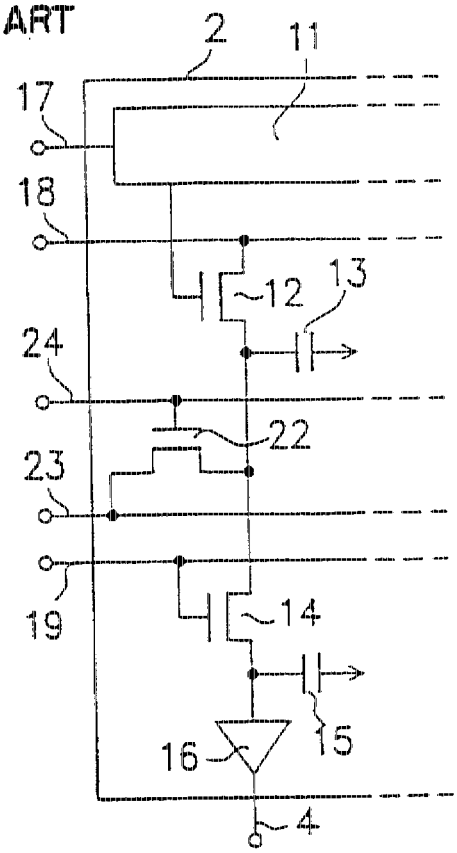
FIG. 20 PRIOR ART
FIG. 20 is a partial circuit diagram of a conventional data signal line driving circuit having a function of precharging a sampling capacitor.

The sampled data will be more safely maintained by precharging the sampling capacitor 13 before the sampling of image data as in the conventional example of FIG. 20.

(EXAMPLE 2)

As Example 1, this example is based on the data signal line driving circuit of the driver-sample-hold type shown in FIG. 15.

Figure 3:
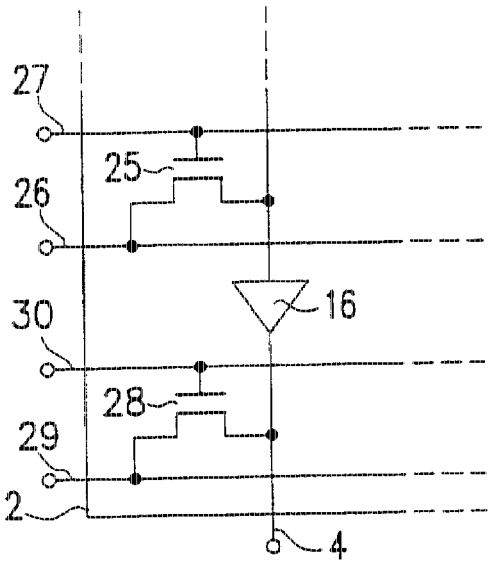
FIG. 3 is a partial circuit diagram of a data signal line driving circuit of the second example according to the present invention.

FIG. 3 is a partial circuit diagram of the data signal line driving circuit of this example. The components having functions similar to those of Example 1 are denoted by the same reference numerals.

In the data signal line driving circuit 2 of this example, each data signal line 4 connected to the output of a buffer circuit 16 is also connected to a data signal line precharging line 29 through the drain-source terminals of an n-channel MOSFET constituting a data signal line precharging switch 28. The gate terminal thereof is connected to a data signal line precharging control signal line 30. Thus, the data signal line precharging switch 28 is switched on/off by a data signal line precharging control signal sent through the data signal line precharging control signal line 30.

As in Example 1, at an appropriate timing in the horizontal scanning period, a holding capacitor precharging control signal line 27 sends a holding capacitor precharging control signal of a high voltage level, turning on a holding capacitor precharging switch 25. A holding capacitor 15 (not shown in FIG. 3) is then precharged with the voltage at a holding capacitor precharging line 26. In this example, simultaneously with the above precharging of the holding capacitor 15, the data signal line precharging control signal line 30 sends the data signal line precharging control signal of a high voltage level, turning on the data signal line precharging switch 28. The data signal line 4 is then precharged with a voltage at the data signal line precharging line 29, which voltage has been set to be of the same polarity as that of the present sampled data and of an intermediate value between the extreme values of the possible voltage of the sampled data, like the holding capacitor precharging line 26.

Therefore, according to this example, in the retrace interval after the completion of the horizontal scanning, a holding switch 14 (not shown in FIG. 3) is turned on by the high-voltage level transmission control signal, allowing the transmission of the sampled data. At this time, not only the holding capacitor 15 but also the data signal line 4 through the buffer circuit 16 can be charged within a short period. In other words, as described above with regard to the precharging of the holding capacitor 15 referring to FIG. 2, since the data signal line 4, as well as the holding capacitor 15, have already been precharged with a voltage of nearly an intermediate value between the extreme values of the possible voltage of the sampled data during a precharging time $T_{PC}$, it can be promptly charged in a short charging time $T_{CH}$.

As a result, according to this example, when the sampled data stored in a sampling capacitor 13 (not shown in FIG. 3) is transmitted to the holding capacitor 15 and then output to the data signal line 4 during the retrace interval of the horizontal scanning, the holding capacitor 15 and the data signal line 4 can be completely charged within a short time period. Therefore, the problem of lost sampled data is prevented.

(EXAMPLE 3)

Figure 16:
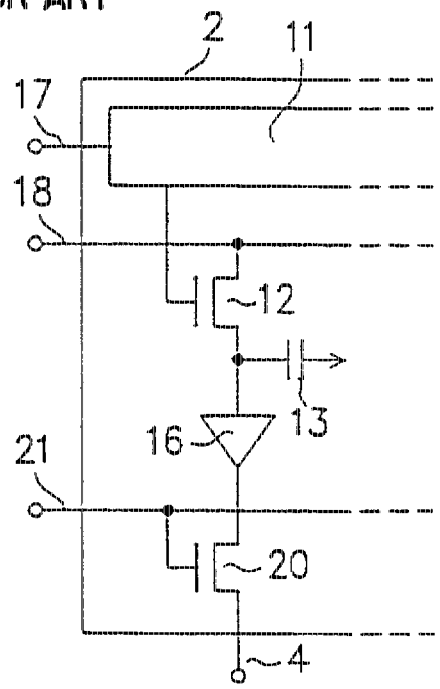
FIG. 16 PRIOR ART
FIG. 16 is a partial circuit diagram of a conventional data signal line driving circuit of a driver-sample panel-hold type.

This example is based on the data signal line driving circuit of the driver-sample panel-hold type shown in FIG. 16.

Figure 4:
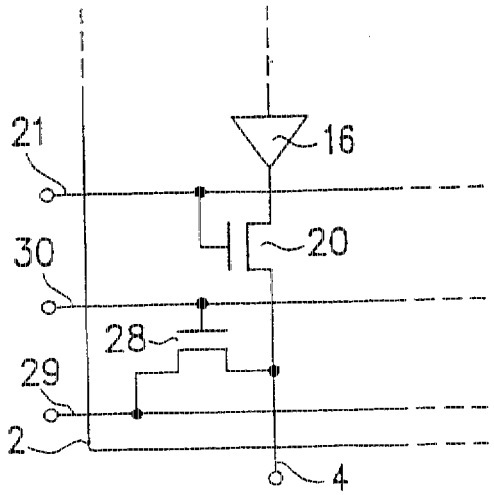
FIG. 4 is a partial circuit diagram of a data signal line driving circuit of the third example according to the present invention.

FIG. 4 is a partial circuit diagram of the data signal line driving circuit of this example. The components having functions similar to those of the above examples are denoted by the same reference numerals.

In the data signal line driving circuit 2 of this example, a terminal of each sampling capacitor 13 (not show in FIG. 4, see FIG. 16) is connected to a data signal line 4 through a buffer circuit 16 and the drain-source terminals of an n-channel MOSFET constituting an output switch 20. The gate terminal thereof is connected to an output control signal line 21. Thus, the output switch 20 is switched on/off by an output control signal sent through the output control signal line 21.

As in Example 2, the data signal line 4 is also connected to a data signal line precharging line 29 through a data signal line precharging switch 28, which is switched on/off by a data signal line precharging control signal sent through a data signal line precharging control signal line 30.

In the data signal line driving circuit 2 of this example, as in previous examples, sampled data is stored in each sampling capacitor 13 by sequential sampling within one horizontal scanning period. At an appropriate timing in the horizontal scanning period, the data signal line precharging control signal line 30 sends the data signal line precharging control signal of a high voltage level, turning on the data signal precharging switch 28. The data signal line 4 is then precharged with a voltage at the data signal line precharging line 29, which voltage has been set to be of the same polarity as that of the present sampled data and of an intermediate value between the extreme values of the possible voltage of the sampled data.

Therefore, according to this example, in the retrace interval after the completion of the horizontal scanning, the output switch 20 is turned on by the high-voltage level output control signal sent through the output control signal line 21. This allows the sampled data stored in the sampling capacitor 13 to be output to the data signal line 4 through the buffer circuit 16. At this time, the data signal line 4 can be charged within a short period. In other words, as described in Example 1 with regard to the precharging of the holding capacitor 15 referring to FIG. 2, since the data signal line 4 has already been precharged with a voltage of nearly an intermediate value between the extreme values of the possible voltage of the sampled data during a precharging time $T_{PC}$, it can be promptly charged in a short charging time $T_{CH}$. This makes it possible to complete the charging of the data signal line 4 by the termination of an ON period $T_{ON}$ of the output switch 20.

As a result, according to this example, when the sampled data stored in the sampling capacitor 13 is output to the data signal line 4 during the retrace interval of the horizontal scanning, the data signal line 4 can be completely charged within a short period. Therefore, the problem of lost sampled data is prevented.

(EXAMPLE 4)

Figure 17:
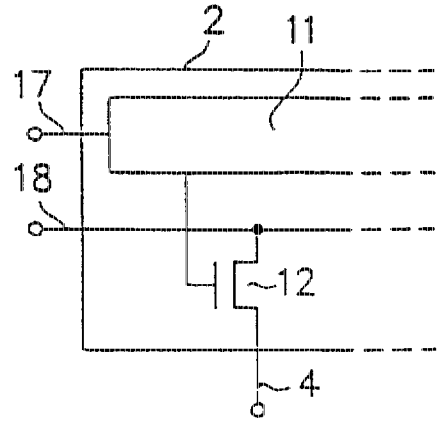
FIG. 17 PRIOR ART
FIG. 17 is a partial circuit diagram of a conventional data signal line driving circuit of a panel-sample type.
Figure 18:
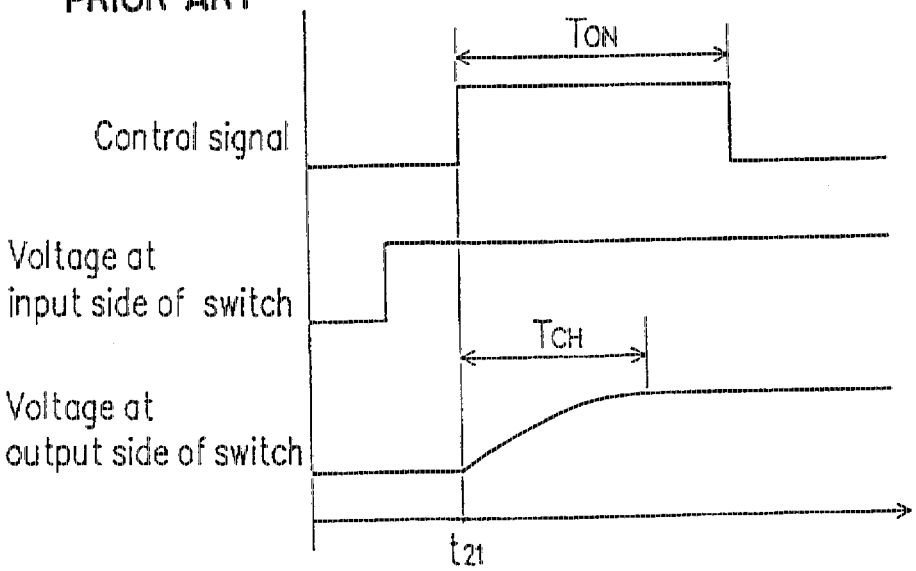
FIG. 18 PRIOR ART
Figure 19:
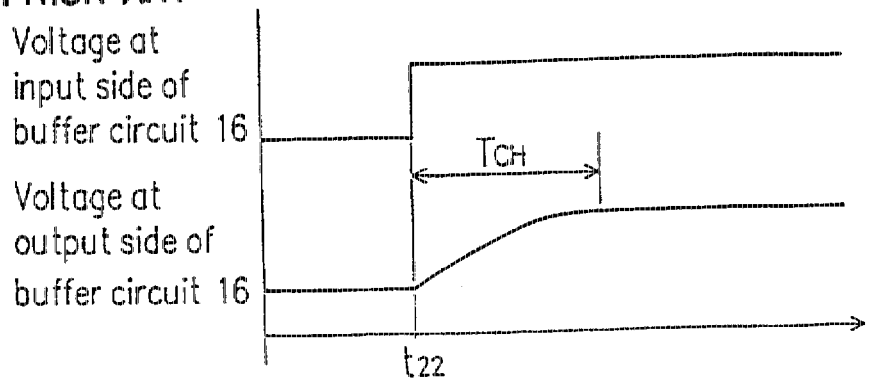
FIG. 19 PRIOR ART
FIG. 19 is a time chart showing the transient performance at the input/output of a buffer circuit of a conventional data signal line driving circuit.

This example is based on the data signal line driving circuit of the panel-sample type shown in FIG. 17.

Figure 5:
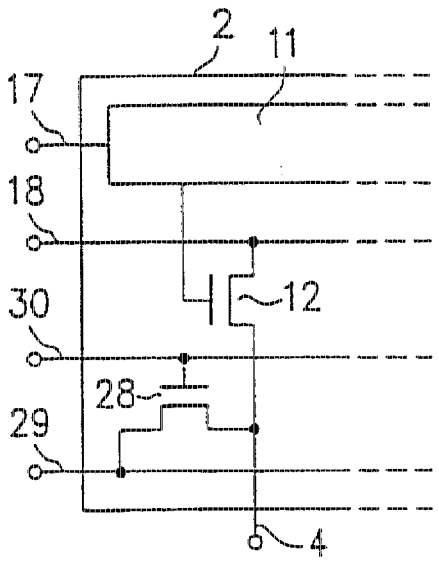
FIG. 5 is a partial circuit diagram of a data signal line driving circuit of the fourth example according to the present invention.

FIG. 5 is a partial circuit diagram of the data signal line driving circuit of this example. The components having functions similar to those of the above examples are denoted by the same reference numerals.

In the data signal line driving circuit 2 of this example, a video signal line 18 is connected to each data signal line 4 through a sampling switch 12 which is controlled by the output signal of a sampling control circuit 11. As in Examples 2 and 3, the data signal line 4 is also connected to a data signal line precharging line 29 through a data signal line precharging switch 28, which is switched on/off by a data signal line precharging control signal sent through a data signal line precharging control signal line 30.

In the data signal line driving circuit 2 of this example, sampled data is directly output to the data signal line 4 by the sequential sampling of image data sent through the video signal line 18 within one horizontal scanning period. Therefore, in this example, at an appropriate timing before the start of the sampling, the data signal line precharging control signal line 30 sends the data signal precharging control signal of a high voltage level, turning on the data signal line precharging switch 28. The data signal line 4 is then precharged with a voltage at the data signal line precharging line 29, which voltage has been set to be of the same polarity as that of the present sampled data and of an intermediate value between the extreme values of the possible voltage of the sampled data.

Therefore, according to this example, the sampling switch 12 is turned on during the sampling period, allowing the image data sent through the video signal line 18 to be sampled and output to the data signal line 4. At this time, the data signal line 4 can be charged within a short period. In other words, as described in Example 1 with regard to the precharging of the holding capacitor 15 referring to FIG. 2, since the data signal line 4 has already been precharged with a voltage of nearly an intermediate value between the extreme values of the possible voltage of the sampled data during a precharging time $T_{PC}$, it can be promptly charged in a short charging time $T_{CH}$. This makes it possible to complete the charging of the data signal line 4 by the termination of an ON period $T_{ON}$ of the sampling switch 12.

As a result, according to this example, when the sampled data is output to the data signal line 4 during the sampling period of the horizontal scanning, the data signal line 4 can be completely charged within a short period. Therefore, the problem of lost sampled data is prevented.

(EXAMPLE 5)

Figure 14:
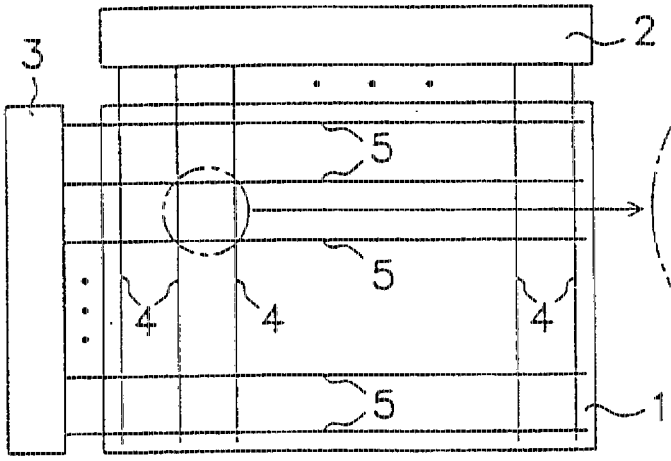
FIG. 14 PRIOR ART
FIGS. 14 and 14A are block diagrams of a conventional matrix type display apparatus, and an enlarged detailed partial view thereof.
Figure 14A:
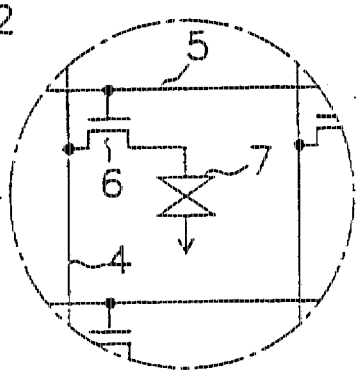
FIG. 14A PRIOR ART

This example is based on the active matrix type display apparatus shown in FIGS. 14 and 14A, and any of the above types of the data signal line driving circuits can be used for this display apparatus.

Figure 6:
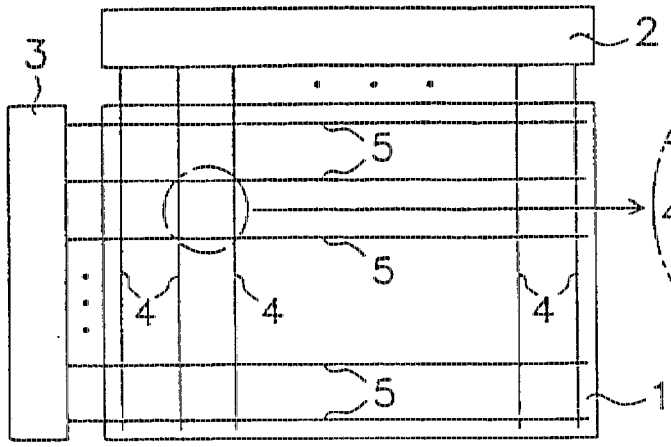
FIGS. 6 an 6A are block diagrams of an active matrix type display apparatus of the fifth example according to the present invention, and an enlarged detailed partial view thereof.
Figure 6A:
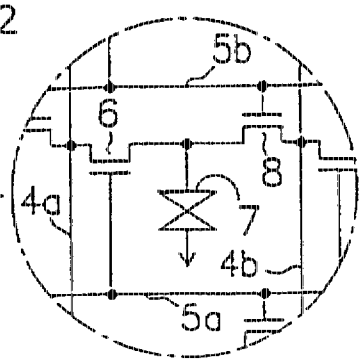
Figure 7:
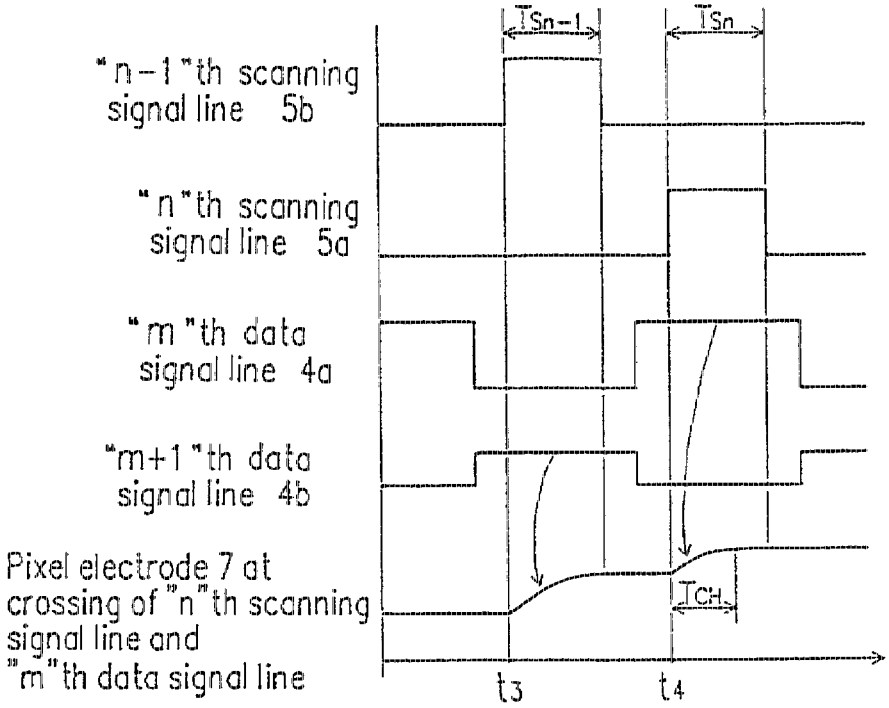
FIG. 7 is a time chart showing the operation of the active matrix type display apparatus of FIGS. 6 and 6A.

FIGS. 6 and 6A are block diagrams of the active matrix type display apparatus of this example, and FIG. 7 a time chart showing the operation of the active matrix type display apparatus of FIGS. 6 and 6A. The components having functions similar to those of the above conventional example are denoted by the same reference numerals.

As shown in FIGS. 6 and 6A, the active matrix display apparatus of this example includes a display panel 1, a data signal line driving circuit 2, and a scanning signal line driving circuit 3. A number of data signal lines 4 and a number of scanning signal lines 5 are formed on the display panel 1, crossing each other. Pixel electrodes 7 are disposed at the respective crossings of the data signal lines 4 and the scanning signal lines 5.

Each pixel includes a pixel switch 6, a pixel electrode 7, and a pixel precharging switch 8. The pixel switch 6 and the pixel precharging switch 8 are composed of an n-channel TFT and an n-channel MOSFET, respectively. The pixel switch 6 connects the pixel electrode 7 to a corresponding data signal line 4*a* through the drain-source terminals of the n-channel TFT constituting the pixel switch 6. The gate terminal thereof is connected to a corresponding scanning signal line 5*a*. The pixel precharging switch 8 connects the pixel electrode 7 to a data signal line 4*b* adjacent to the data signal line 4*a* through the drain-source terminals of the n-channel MOSFET constituting the pixel precharging switch 8. The gate terminal thereof is connected to a scanning signal line 5*b* which is scanned prior to the scanning signal line 5*a*.

FIG. 7 shows the operation of the active matrix type display apparatus with the above structure when image data is written on a pixel at the crossing of the "n"th scanning signal line 5*a* and the "m"th data signal line 4*a*. The pixel precharging switch 8 of this pixel is turned on at time t3 by the scanning of the "n−1"th scanning signal line 5*b*. Then, the pixel electrode 7 of this pixel is precharged with a voltage at the "m+1"th data signal line 4*b* over a scanning period $T_{Sn-1}$ for the "n−1"th scanning signal line 5*b*. The active matrix type display apparatus of this example is set so that the polarity of the voltage at the data signal lines 4 will be reversed every horizontal scanning period and any adjacent data signal lines 4 will be loaded with voltages having reverse polarities to each other. Therefore, the data signal supplied to the adjacent data signal line 4 before one horizontal scanning period and the data signal applied to the present pixel have the same polarity. Further, any adjacent data signal lines 4 possibly have voltage values closer to each other because the image data to be written thereon are correlative with each other. As a result, when the pixel electrode 7 of this pixel is precharged with the voltage at the "m+1"th data signal line 4*b* over the scanning period $T_{Sn-1}$ for the "n−1"th scanning signal line 5*b*, it means that it is charged with a voltage closer to a voltage value obtained from the "m"th data signal line 4*a* during the scanning of the "n"th scanning signal line 5*a*.

Thereafter, when the pixel at the crossing of the "n"th scanning signal line 5*a* and the "m"th data signal line 4*a* is selected at time t4 by the scanning of the "n"th scanning signal line 5*a*, the corresponding pixel switch 6 is turned on. Then, the pixel electrode 7 is charged with the voltage at the "m"th data signal line 4*a* over a scanning period $T_{Sn}$ for the "n"th scanning signal line 5*a*. Since the pixel electrode 7 has already been precharged, it can be promptly charged in a short precharging time $T_{CH}$.

As a result, according to this example, when the pixel electrode 7 is charged with the voltage at the data signal line 4 upon scanning of the scanning signal line 5, the pixel electrode 7 can be completely charged within a short period. Therefore, the problem of lost sampled data is prevented.

(EXAMPLE 6)

As Example 5, this example is based on the active matrix type display apparatus shown in FIGS. 14 and 14A, and any of the above types of data signal line driving circuits 2 can be used for this display apparatus.

Figure 8:
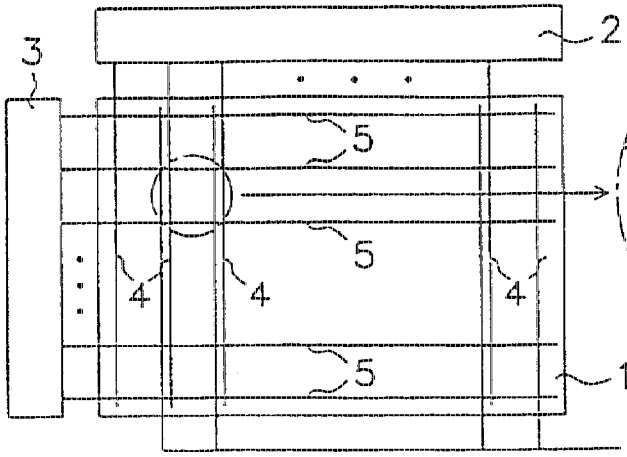
FIG. 8 and 8A are block diagrams of an active matrix type display apparatus of the sixth example according to the present invention, and an enlarged detailed partial view thereof.
Figure 8A:
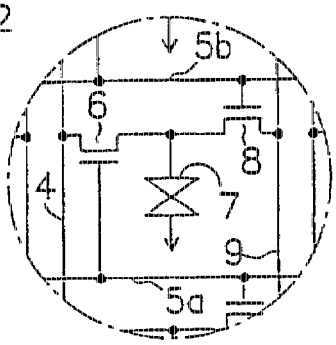

FIGS. 8 and 8A are block diagrams of the active matrix type display apparatus of this example. The components having functions similar to those of Example 5 are denoted by the same reference numerals.

The active matrix display apparatus of this example includes a number of pixel precharging lines 9 running parallel to data signal lines 4 on a display panel 1. As in Example 5, each pixel includes a pixel switch 6, a pixel electrode 7, and a pixel precharging switch 8. The pixel switch 6 connects the pixel electrode 7 to the corresponding data signal line 4 through the drain-source terminals thereof. The gate terminal of the pixel switch 6 is connected to a corresponding scanning signal line 5*a*. The gate terminal of the pixel precharging switch 8 is connected to a scanning signal line 5*b* which is scanned prior to the scanning signal line 5*a*. This example is different from Example 5 in that the pixel precharging switch 8 connects the pixel electrode 7 to the adjacent pixel precharging line 9 through the drain-source terminals thereof. The pixel precharging line 9 is set to have a voltage of the same polarity as that of a voltage at the data signal line 4 and of an intermediate value between the extreme values of the possible voltage at the data signal line 4 during the scanning thereof.

In the active matrix type display apparatus with the above structure, the pixel precharging switch 8 is turned on by the scanning of the scanning signal line 5*b* before the scanning of the scanning signal line 5*a*. Then, the pixel electrode 7 is precharged with the voltage at the pixel precharging line 9; that is, it is charged with a voltage of nearly an intermediate value between the extreme values of the possible voltage at the data signal line 4 during the scanning thereof.

Thereafter, the corresponding scanning signal line 5*a* is selected and scanned, turning on the pixel switch 6. Then, the pixel electrode 7 is charged with the voltage at the corresponding data signal line 4. Since the pixel electrode 7 has already been precharged, it can be promptly charged in a short precharging time $T_{CH}$ as the case shown in FIG. 7.

As a result, according to this example, when the pixel electrode 7 is charged with the voltage at the data signal line 4 upon scanning of the scanning signal line 5, the pixel electrode 7 can be completely charged within a short period. Therefore, the problem of lost sampled data is prevented.

(EXAMPLE 7)

This example relates to controlling a sampling control circuit 11 of a data signal line driving circuit 2 for precharging a sampling capacitor or a data signal line, and is applicable to any of the above types of data signal line driving circuits.

Figure 9:
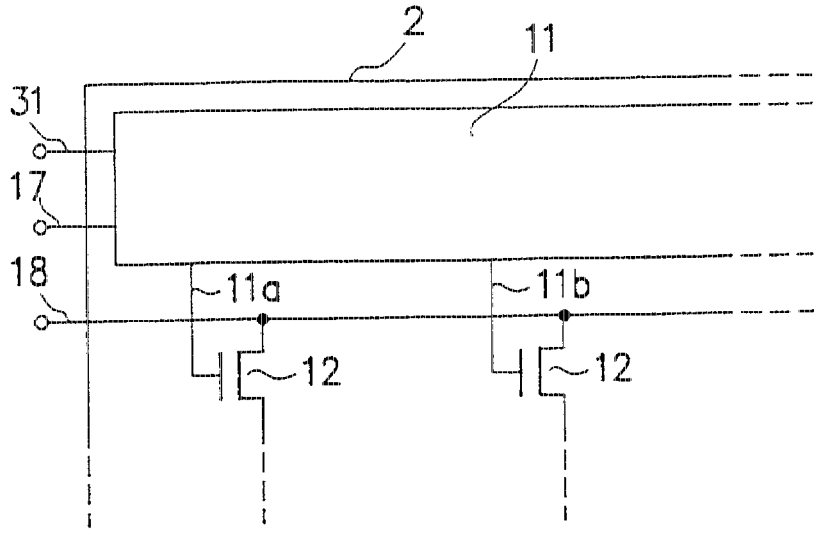
FIG. 9 is a partial circuit diagram of a data signal line driving circuit of the seventh example according to the present invention.
Figure 10:
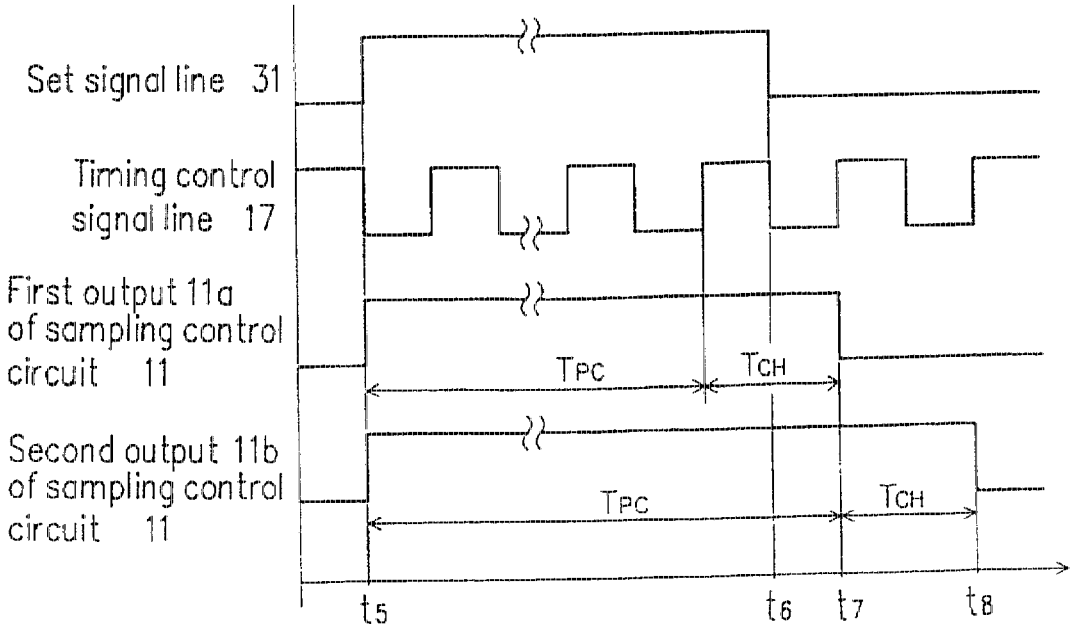
FIG. 10 is a time chart showing the operation of the data signal line driving circuit of FIG. 9.

FIG. 9 is a partial circuit view of the data signal line driving circuit 2 of this example, and FIG. 10 is a time chart showing the operation of the data signal line driving circuit 2 of FIG. 9. The components having functions similar to those of the above examples are denoted by the same reference numerals.

In the data signal line driving circuit 2 of this example, each of outputs 11*a*, 11*b* . . . of the sampling control circuit 11 is connected to the gate terminal of an n-channel MOSFET constituting each sampling switch 12. The sampling switch 12 connects a video signal line 18 to a subsequent component of the circuit through the drain-source terminals thereof. More specifically, the video signal line 18 is connected to a sampling capacitor 13 (not shown in FIG. 9) in the case of the driver-sample-hold type or the driver-sample panel-hold type, or to a data signal line 4 (not shown in FIG. 9) in the case of the panel-sample type, through the sampling switch 12.

In this example, the sampling control circuit 11 receives both a timing control signal from a timing control signal line 17 and a set signal from a set signal line 31. In turn, it outputs a sampling signal to each of the outputs 11*a*, 11*b*, . . . The sampling signals at the outputs 11*a*, 11*b*, . . . are kept in a high voltage level as far as the set signal is in a high voltage level. After the set signal falls to a low voltage level, the sampling signals fall to a low voltage level one by one synchronously with the rise of the pulse of the timing control signal line 17.

FIG. 10 shows the operation of the data signal line driving circuit 2 with the above configuration. When the retrace interval starts after the completion of the horizontal scanning at time t5, the set signal sent from the set signal line 31 rises to a high voltage level. This turns all the outputs 11*a*, 11*b*, . . . to a high voltage level, allowing the respective sampling switches 12 to be turned on. Thus, the respective sampling capacitors 13 or data signal lines 4 are precharged with image data of the same polarity sent at that time through the video signal line 18.

When the retrace interval terminates at time t6, the set signal falls to a low voltage level. Thereafter, at time t7 when the timing control signal first rises, the first output 11*a* is turned to a low voltage level. At time t8 when the timing control signal secondly rises, the second output 11*b* is turned to a low voltage level. In this way, all the outputs of the sampling control circuit 11 are turned to a low voltage level one by one.

Thus, for the first circuit connected to the sampling switch 12 which is controlled by the first output 11*a*, the period from time t5 to the rise of the timing control signal immediately before time t6 corresponds to the precharging time $T_{PC}$, and the subsequent period until time t7 corresponds to the charging time $T_{CH}$. For the second circuit connected to the sampling switch 12 which is controlled by the second output 11*b*, the period from time t5 to time t7 corresponds to the precharging time $T_{PC}$, and the subsequent period until time t8 corresponds to the charging time $T_{CH}$.

As a result, according to this example, the sampling of image data is simultaneously started at all the outputs 11*a*, 11*b*, . . . of the sampling control circuit 11, but it is terminated at different times. Since the sampling capacitors 13 or the data signal lines 4 are precharged with the image data of the same polarity by this overlap sampling, they can be completely charged without the problem of lost sampled data.

(EXAMPLE 8)

As Example 7, this example relates to controlling a sampling control circuit 11 of a data signal line driving circuit 2 for precharging a sampling capacitor or a data signal line, and is applicable to any of the above types of data signal line driving circuits.

Figure 11:
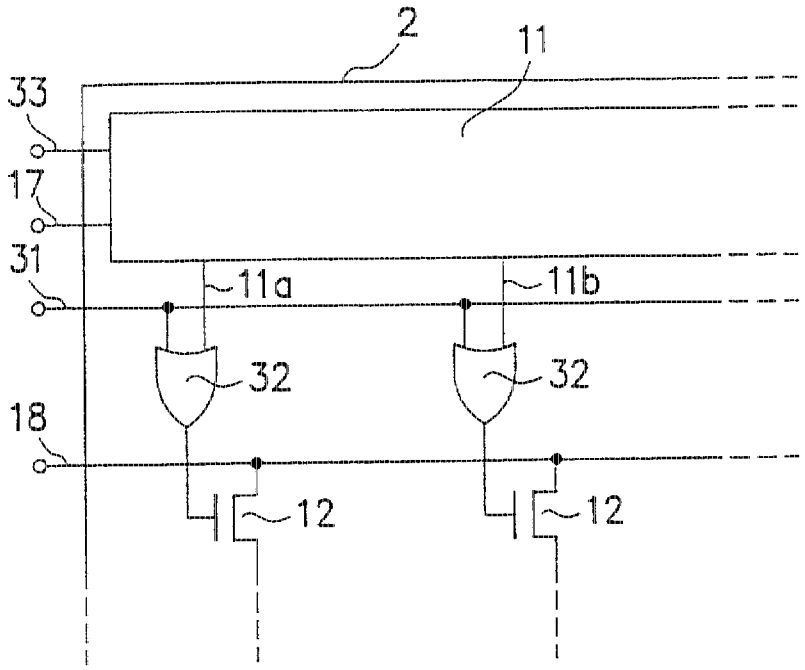
FIG. 11 is a partial circuit diagram of a data signal line driving circuit of the eighth example according to the present invention.
Figure 12:
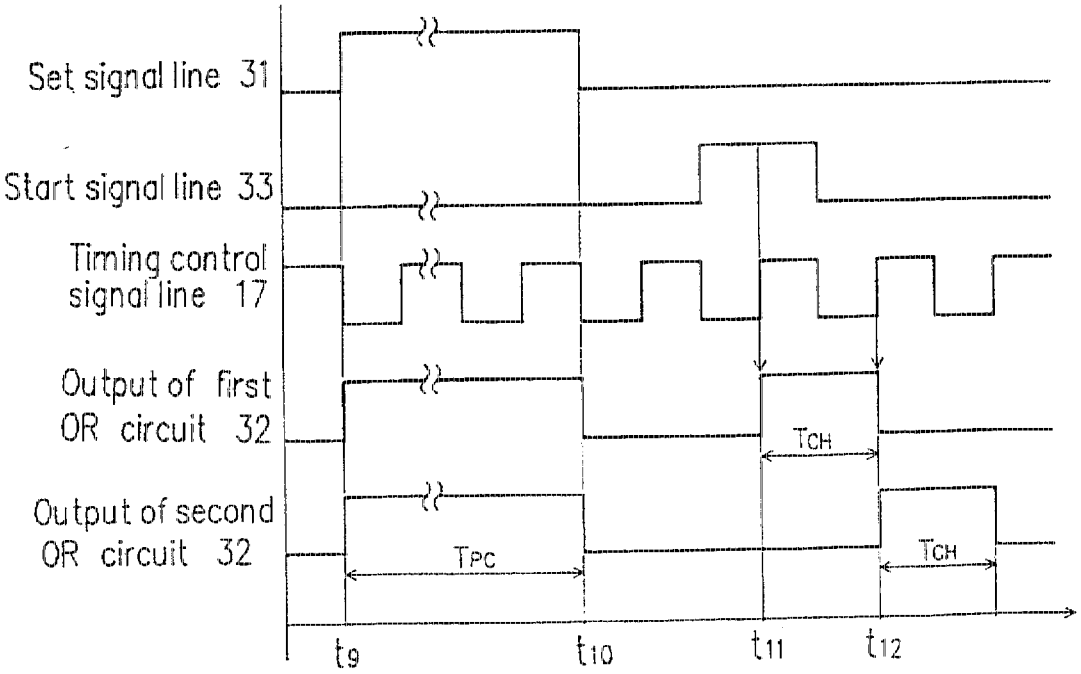
FIG. 12 is a time chart showing the operation of the data signal line driving circuit of FIG. 11.

FIG. 11 is a partial circuit view of the data signal line driving circuit 2 of this example, and FIG. 12 is a time chart showing the operation of the data signal line driving circuit 2 of FIG. 11. The components having functions similar to those of the above examples are denoted by the same reference numerals.

In the data signal line driving circuit 2 of this example, each of outputs 11*a*, 11*b*, . . . of the sampling control circuit 11 is connected to an input terminal of a corresponding OR circuit 32. The other input terminal of the OR circuit 32 is connected to a set signal line 31 identical to that of Example 7. The output terminal of the OR circuit 32 is connected to the gate terminal of an n-channel MOSFET constituting a sampling switch 12. The sampling switch 12 connects a video signal line 18 to a subsequent component of the circuit through the drain-source terminals thereof as in Example 7.

In this example, the sampling control circuit 11 receives both a timing control signal from a timing control signal line 17 and a start signal from a start signal line 33. In the sampling control circuit 11, the start signal is sequentially shifted by the timing control signal, and the shifted start signal is sequentially output to the outputs 11*a*, 11*b*, . . . as a sampling signal.

FIG. 12 shows the operation of the data signal line driving circuit 2 with the above configuration. When the retrace interval starts after the completion of the horizontal scanning at time t9, a set signal sent from the set signal line 31 rises to a high voltage level. This turns all the OR circuits 32 to a high voltage level, allowing the respective sampling switches 12 to be turned on. Thus, respective sampling capacitors 13 or data signal lines 4 (both not shown in FIG. 11) are precharged with image data of the same polarity sent at that time through the video signal line 18. When the retrace interval terminates at time t10, the set signal falls to a low voltage level. Then, the outputs of the OR circuits 32 are turned to a low voltage level, terminating the precharging time $T_{PC}$.

Thereafter, the start signal is input to the sampling control circuit 11. When the timing control signal first rises after the input of the start signal at time t11, the first output 11*a* of the sampling control circuit 11 is turned to a high voltage level. This turns the output of the corresponding OR circuit 32 to a high voltage level, starting the charging time $T_{CH}$ for the first data signal line. At time t12 when the timing control signal secondly rises, the output of the OR circuit 32 returns to a low voltage level, terminating the charging time $T_{CH}$. At the same time, the output of the next OR circuit 32 is turned to a high voltage level, starting the charging time $T_{CH}$ for the second data signal line. In this way, the outputs of all the OR circuits 32 are sequentially put in a high voltage level for the respective charging times $T_{CH}$.

Thus, for the circuits connected to the sampling switches 12, the period from time t9 to time t10 is given as the common precharging time $T_{PC}$, and the later individual sampling periods correspond to the respective charging times $T_{CH}$.

As a result, according to this example, since the sampling capacitors 13 or the data signal lines 4 are simultaneously precharged with image data of the same polarity through the sampling switches 12, they can be completely charged during the individual sampling periods. Therefore, the problem of lost sampled data is prevented.

(EXAMPLE 9)

This example relates to controlling a sampling control circuit 11 of a data signal line driving circuit 2 for precharging a sampling capacitor or a data signal line through which image data is sent, and is applicable to any of the above types of data signal line driving circuits.

Figure 13:
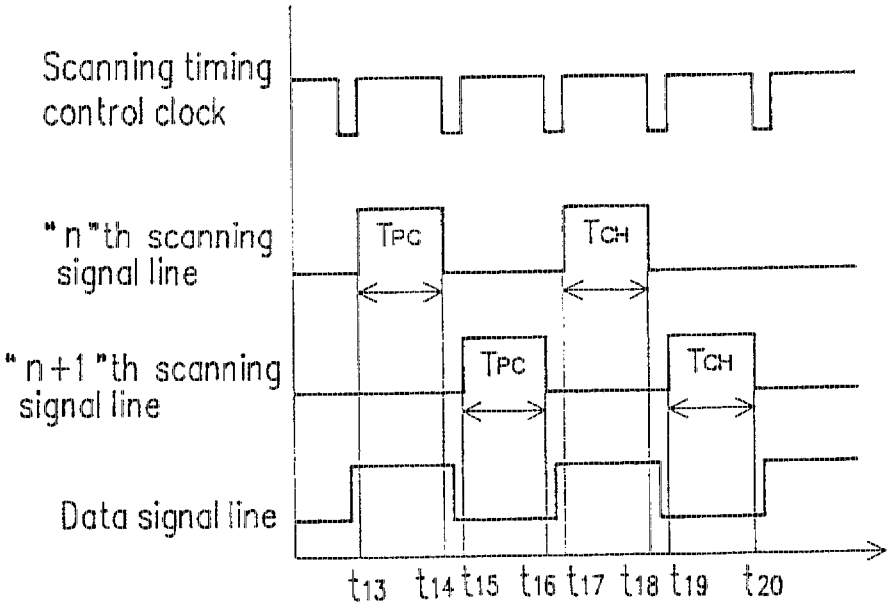
FIG. 13 is a time chart showing scanning signals used in the ninth example according to the present invention.

FIG. 13 is a time chart showing scanning signals used for this example.

In this example, each scanning signal line is scanned twice within one vertical period based on the scanning timing control signal. These two scannings of the scanning signal line are conducted when image data sent through data signal lines has the same polarity. The number of scannings of one scanning signal line is not limited to two, but three or more scannings are possible as far as the scannings are conducted when image data of the same polarity is sent through the data signal lines.

According to this double scanning, during the first scanning period from time t13 to time t14, the row of pixels connected to the "n"th scanning signal line are precharged with image data of the same polarity as that of image data to be charged later. Therefore, they can be completely charged during the second scanning period from time t17 to time t18. Likewise, during the first scanning period from time t15 to time t16, the row of pixels connected to the "n+1"th scanning signal line are precharged with image data of the same polarity as that of image data to be charged later. Therefore, they can be completely charged during the second scanning period from time t19 to time t20. In other words, for the rows of pixels connected to the "n"th and "n+1"th scanning signal lines, the period from time t13 to time t14 and the period from time t15 to time t6 respectively correspond to the precharging time $T_{PC}$, and the period from time t17 to time t18 and the period from time t19 to time t20 respectively correspond to the charging time $T_{CH}$.

As a result, according to this example, since the row of pixels are precharged with image data of the same polarity during the first scanning period, they can be completely charged during the second scanning period.

The present invention is not limited to the above examples, but includes any precharging means for precharging sampling capacitors, holding capacitors, data signal lines, and pixel electrodes, except for the conventional example shown in FIG. 20.

The present invention is especially effective for application to a display apparatus with a relatively large capacitive load, such as a liquid crystal display apparatus and a large-screen display apparatus, and to a display apparatus where driving circuits and a pixel portion are formed on the same substrate by using polysilicon thin film transistors, single crystal silicon LSIs, or the like. Further, it is most effective for application to a high precision liquid crystal display apparatus which requires high-speed data writing, such as a display apparatus for a high definition TV set.

As described above, according to the matrix type display apparatus and the method for driving the same of present invention, the charging to the holding capacitors, the data signal lines, and the pixel electrodes can be shortened by precharging these components. This precharging can be accomplished with a simple structure. Thus, high resolution and high definition display apparatuses can be realized without troubles such as defective display due to insufficient charging.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A matrix type display apparatus, comprising:

pixel electrodes arranged in a matrix;

data signal lines and scanning signal lines for driving the pixel electrodes; and a data signal line driving circuit including:

sampling capacitors for keeping sampled data obtained by sequentially sampling image data over one horizontal scanning period;

holding capacitors for holding the sampled data transmitted from the sampling capacitors upon termination of the horizontal scanning period and then outputting the sampled data to data signal lines as a data signal; and precharging means for precharging the corresponding holding capacitors by applying a predetermined voltage to the holding capacitors before the sampled data is transmitted to the holding capacitors.

2. A matrix type display apparatus according to claim 1, wherein each of the precharging means includes:

a precharging switch temporarily turned on by a precharging signal before the sampled data is transmitted to the holding capacitor; and a precharging line connected to the holding capacitor through the precharging switch and loaded with a predetermined voltage.

3. A matrix type display apparatus according to claim 1, wherein the polarity of the potential for the precharging is the same as the polarity of the data signal.

4. A matrix type display apparatus according to claim 1, wherein the potential for the precharging has an intermediate value between extreme values of the potential of the data signal.

5. A matrix type display apparatus, comprising:

pixel electrodes arranged in a matrix;

data signal lines and scanning signal lines for driving the pixel electrodes; and a data signal line driving circuit including:

sampling capacitors for keeping sampled data obtained by sequentially sampling image data over one horizontal scanning period;

holding capacitors for holding the sampled data transmitted during one horizontal scanning period and then outputting the sampled data to data signal lines as a data signal; and precharging means for precharging the corresponding holding capacitors by applying a predetermined voltage to the holding capacitors and the data signal lines before the sampled data is transmitted to the holding capacitors.

6. A matrix type display apparatus according to claim 5, wherein each of the precharging means includes:

a precharging switch temporarily turned on by a precharging signal before the sampled data is transmitted to the holding capacitor; and a precharging line connected to the holding capacitor through the precharging switch and loaded with a predetermined voltage.

7. A matrix type display apparatus according to claim 5, wherein the polarity of the potential for the precharging is the same as the polarity of the data signal.

8. A matrix type display apparatus according to claim 5, wherein the potential for the precharging has an intermediate value between extreme values of the potential of the data signal.

9. A matrix type display apparatus comprising:

pixel electrodes arranged in a matrix;

data signal lines and scanning signal lines for driving the pixel electrodes; and a data signal line driving circuit including sampling capacitors for keeping sampled data obtained by sequentially sampling image data over one horizontal scanning period and then outputting the sampled data to data signal lines as a data signal, and precharging means for precharging the corresponding data signal lines by applying a predetermined voltage to the data signal lines before the sampled data is output to the data signal lines, the predetermined voltage for a corresponding data signal line having a polarity that is the same as a polarity of the sampled data output to the corresponding data signal line, even if the polarity of the sampled data is inverted.

10. A matrix type display apparatus according to claim 9, wherein each of the precharging means includes:

a precharging switch temporarily turned on by a precharging signal before the sampled data is output to the data signal line; and a precharging line connected to the data signal line through the precharging switch and loaded with a predetermined voltage.

11. A matrix type display apparatus according to claim 9, wherein the potential for the precharging has an intermediate value between extreme values of the potential of the data signal.

12. A matrix type display apparatus, comprising:

pixel electrodes arranged in a matrix;

data signal lines and scanning signal lines for driving the pixel electrodes;

holding capacitors for holding data and for outputting the data to corresponding data signal lines;

pixel switches each turned on by a signal sent through the corresponding scanning signal line for supplying a current from the corresponding data signal line to the corresponding pixel electrode; and precharging means for precharging the corresponding pixel electrodes by applying a predetermined voltage to the corresponding pixel electrodes before the corresponding pixel switch is turned on by the signal sent through the corresponding scanning signal lines, the predetermined voltage for a corresponding pixel electrode having a polarity that is the same as a polarity of the data output to the corresponding data signal line of the corresponding pixel electrode, even if the polarity of the data is inverted.

13. A matrix type display apparatus according to claim 12, wherein each of the precharging means includes a precharging switch disposed for each pixel electrode and turned on by one of the scanning signal lines selected prior to the corresponding scanning signal line for turning on the pixel switch for the corresponding pixel electrode, and the corresponding pixel electrode is connected to a data signal line adjacent to the corresponding data signal line through the precharging switch.

14. A matrix type display apparatus according to claim 12, wherein each of the precharging means includes:

a precharging switch disposed for each pixel electrode and turned on by one of the scanning signal lines selected prior to the corresponding scanning signal line for turning on the pixel switch for the corresponding pixel electrode; and a precharging line connected to the corresponding pixel electrode through the precharging switch and loaded with the predetermined voltage.

15. A matrix type display apparatus according to claim 12, wherein the potential for the precharging has an intermediate value between extreme values of the potential of the data signal.

16. A matrix type display apparatus, comprising:

pixel electrodes arranged in a matrix;

data signal lines and scanning signal lines for driving the pixel electrodes; and a data signal line driving circuit including sampling switches for sequentially sampling image data over one horizontal scanning period, each of the sampling switches being connected to the corresponding data signal line for outputting sampled data to the data signal line as a data signal, sampling capacitors for keeping sampled data, and precharge sampling means for effecting precharge sampling by turning on the sampling switches for applying a predetermined voltage to the data signal lines after the completion of the last horizontal scanning period and before the start of the proper sampling period for the respective sampling switches, the predetermined voltage for a corresponding data signal line having a polarity that is the same as a polarity of the sampled data output to the corresponding data signal line, even if the polarity of the sampled data is inverted.

17. A matrix type display apparatus according to claim 16, wherein the potential for the precharging has an intermediate value between extreme values of the potential of the data signal.

18. A matrix type display apparatus, comprising:

pixel electrodes arranged in a matrix;

data signal lines and scanning signal lines for driving the pixel electrodes; and a data signal line driving circuit including sampling switches for sequentially sampling image data over one horizontal scanning period, each of the sampling switches being connected to a sampling capacitor for outputting sampled data obtained by the sampling to the sampling capacitor as a data signal, the sampling capacitor holding the sampled data, and precharge sampling means for effecting precharge sampling by turning on the sampling switches for applying a predetermined voltage to the sampling capacitors after the completion of the last horizontal scanning period and before the start of the proper sampling period for the respective sampling switches, the predetermined voltage applied to a corresponding sampling capacitor having a polarity that is the same as a polarity of the sampled data output to the corresponding sampling capacitor, even if the polarity of the sampled data is inverted.

19. A matrix type display apparatus according to claim 18, wherein the potential for the precharging has an intermediate value between extreme values of the potential of the data signal.

20. A driving method for driving data signal lines of a matrix type display apparatus including pixel electrodes arranged in a matrix and data and scanning signal lines connected to the pixel electrodes, the driving method comprising the steps of:

(a) sampling image data over one horizontal scanning period and storing the sampled image data in a plurality sampling capacitors;

(b) precharging a plurality of holding capacitors with a predetermined voltage;

(c) holding the sampled data in the plurality of holding capacitors subsequent to said step (b) of precharging, the sampled data being transferred from corresponding sampling capacitors upon termination of the one horizontal scanning period; and (d) outputting the sampled data from the holding capacitors to the data signal lines.

21. A driving method for driving data signal lines of a matrix type display apparatus including pixel electrodes arranged in a matrix and data and scanning signal lines connected to the pixel electrodes, the driving method comprising the steps of:

(a) sampling image data over one horizontal scanning period and storing the sampled image data in a plurality of sampling capacitors;

(b) precharging a plurality of holding capacitors with a predetermined voltage;

(c) holding the sampled data in the plurality of holding capacitors subsequent to said step (b) of precharging, the sampled data being transferred from corresponding sampling capacitors during the one horizontal scanning period; and (d) outputting the sampled data from the holding capacitors to the data signal lines.

22. A driving method for driving data signal lines of a matrix type display apparatus including pixel electrodes arranged in a matrix and data and scanning signal lines connected to the pixel electrodes, the driving method comprising the steps of:

(a) sampling image data over one horizontal scanning period and storing the sampled image data in a plurality of sampling capacitors corresponding to each data signal line;

(b) precharging the plurality of data signal lines with a predetermined voltage; and (c) outputting the sampled data from the sampling capacitors to the data signal lines, subsequent to said step (b) of precharging, the predetermined voltage of a corresponding data signal line of said step (b) having a polarity that is the same as a polarity of the image data applied to the corresponding data signal line, even if the plurality of the image data is inverted.

23. A driving method for driving data signal lines of a matrix type display apparatus including pixel electrodes arranged in a matrix and data and scanning signal lines connected to the pixel electrodes, the drive method comprising the steps of:

(a) holding image data in a plurality of holding capacitors;

(b) precharging the plurality of pixel electrodes with a predetermined voltage; and (c) turning on each of a plurality of pixel switches subsequent to said step (b) of precharging to enable supply of current from a corresponding data signal line to each corresponding pixel electrode, one pixel switch corresponding to each pixel electrode, the predetermined voltage of a corresponding pixel electrode of said step (b) having a polarity that is the same as a polarity of the image data applied to the corresponding data signal line, even if the polarity of the image data is inverted.

24. A method of driving a matrix type display apparatus including a plurality of scanning signal lines and a plurality of data signal lines comprising:

scanning each of the plurality of scanning signal lines a plurality of times within one vertical synchronization period, wherein a first pulse signal is applied to an nth scanning signal line of the plurality of scanning signal lines for precharging the nth scanning signal line during a first scanning period when image data applied to the data signal lines has the same polarity as the first pulse signal, and a second pulse signal is subsequently applied to the nth scanning signal line for charging the nth scanning signal line during a second scanning period when the image data applied to the data signal lines has the same polarity as the second pulse signal.

* * * * *